United States Patent [19]

Uchida et al.

[11] Patent Number: 4,913,122

[45] Date of Patent: Apr. 3, 1990

[54] AIR-FUEL RATIO CONTROL SYSTEM

[75] Inventors: Masaaki Uchida; Shisei Kai, both of Yokosuka, Japan

[73] Assignee: Nissan Motor Company Limited, Yokohama, Japan

[21] Appl. No.: 141,732

[22] Filed: Jan. 11, 1988

[30] Foreign Application Priority Data

Jan. 14, 1987 [JP] Japan ..... 62-7771

[51] Int. Cl.[4] ..... F02D 41/14

[52] U.S. Cl. ..... 123/489; 123/486

[58] Field of Search ..... 123/489, 486, 440, 480

[56] References Cited

U.S. PATENT DOCUMENTS

| | | | |
|---|---|---|---|
| 4,445,481 | 5/1984 | Aoki et al. | 123/440 |
| 4,498,445 | 2/1985 | Hasegawa et al. | 123/489 |
| 4,526,153 | 7/1985 | Hasegawa et al. | 123/489 |
| 4,669,439 | 6/1987 | Mamiya et al. | 123/489 |

FOREIGN PATENT DOCUMENTS

| | | | |
|---|---|---|---|
| 56-121842 | 9/1981 | Japan . | |
| 59-51147 | 3/1984 | Japan . | |
| 59-54750 | 3/1984 | Japan | 123/489 |
| 60-101235 | 6/1985 | Japan | 123/489 |
| 60-190632 | 9/1985 | Japan | 123/440 |
| 2165063 | 4/1986 | United Kingdom . | |

*Primary Examiner*—Andrew M. Dolinar

*Attorney, Agent, or Firm*—Foley & Lardner, Schwartz, Jeffery, Schwaab, Mack, Blumenthal & Evans

[57] ABSTRACT

An air-fuel ratio control system for controlling the air-fuel ratio of air-fuel mixture to be inducted into an automotive engine in order to accomplish feedback control of the air-fuel ratio into a stoichiometric level of feedforward control of the air-fuel ratio into a lean level. The air-fuel ratio control system is comprised of a control unit which is electrically connected to an oxygen sensor for detecting the air-fuel ratio and to a variety of sensors for detecting engine operating condition. The control unit is adapted to calculate an air-fuel ratio correction coefficient in accordance with the detected air-fuel ratio. The feedback control of the air-fuel ratio is accomplished in accordance with the air-fuel ratio correction coefficient. The control unit is further adapted to form a plurality of learning areas defined respectively by engine operating conditions. Learning is made in each learning area. At least a part of each learning area is under the feedback control. The control unit is adapted to further calculate a learning coefficient for the learning area corresponding to the detected engine operating condition, in accordance with the air-fuel ratio correction coefficient under the feedback control. The learning coefficient is memorized in the above-mentioned at least a part of each learning area. The feedforward control of the air-fuel ratio is accomplished in accordance with the learning coefficient in the learning area corresponding to the detected engine operating condition, thereby improving the precision of control in the feedforward control of the air-fuel ratio.

11 Claims, 9 Drawing Sheets

JOB-1
P1
FBYA < 1 ?
NO
YES
P2
TP < 2.7ms ?
NO
P9
NO
TP <2.0ms ?
YES
YES
P3
TP ≧ 0.6ms ?
NO
P10
NO
TP ≧ 0.7ms ?
YES
YES
P4
N < 2800rpm ?
NO
P11
NO
N < 2600rpm ?
YES
YES
P5
N ≧ 800rpm
NO
P12
NO
N ≧ 900rpm ?
YES
YES
P6
OTHER LEAN COND. MET ?
NO
P13
NO
OTHER LEAN COND. MET ?
YES
YES
P7
FBYA ← X
P8
FBYA ← 1
END

AIR-FUEL RATIO CONTROL SYSTEM

BACKGROUND OF THE INVENTION

1. Field of the Invention

The present invention relates to an air-fuel ratio control system for an internal combustion engine by which air-fuel ratio of air-fuel mixture to be inducted into the engine is controlled at target levels, and more particularly to the system for carrying out so-called cruising lean control in which the air-fuel ratio is changed from a stoichiometric target level to a lean target level in accordance with engine operating conditions.

2. Description of the Prior Art

Recently there has been a tendency of imposing higher requirements to automotive engines in which particularly achievement of exhaust emission improvement, high power output and high fuel economy is required at higher levels although they are conflicting with each other.

In view of this, so-called cruising lean control has been proposed and tried in which the air-fuel ratio of air-fuel mixture to be supplied to the engine is controlled at a lean value in a relatively low engine load operating condition particularly from the view point of fuel economy, although the air-fuel ratio is usually controlled at a stoichiometric value. An air-fuel ratio control system for carrying out such control is disclosed, for example, in Japanese Patent Provisional Publication No. 59-51147.

With this air-fuel ratio control system, a lean air-fuel ratio is selected in a predetermined operating region or condition determined from vehicle load and acceleration which are calculated in accordance with intake pipe pressure, changing rate of engine speed (or changing rate of vehicle speed) and throttle valve position, thereby improving fuel economy. In addition, learning control has been proposed from the view-point of improving exhaust emission, in which deviation between an air-fuel ratio correction coefficient and its target level in a stoichiometric air-fuel ratio control is memorized in accordance with output of an oxygen sensor, thereby accomplishing a feedback control of the air-fuel ratio correction coefficient into the target level as disclosed in Japanese Patent Provisional Publication No. 56-121842.

However, with such conventional air-fuel ratio control systems, the cruising lean control (or feedforward control) is carried out in a lean region in accordance with a learning coefficient obtained upon learning during the stoichiometric control (or feedback control into the stoichiometric value). Accordingly, a learning value in the lean region is usually not learned, thus lowering precision of the learning value in the lean region. This lowers the precision of air-fuel ratio control in the feedforward control thereby resulting in deteriorated exhaust emission and driveability. Such problems are particularly severe in the air-fuel ratio control system accomplishing the cruising lean control. Otherwise, such conventional air-fuel ratio control systems may be somewhat improved by using high precision sensors; however, such sensors are very expensive thereby inviting high production cost of the system.

Thus, with the conventional air-fuel ratio control system in which the cruising lean control and the learning control are merely combined, none of the feedback control of air-fuel ratio and the learning control is carried out in the lean region in which a lean air-fuel ratio is selected. Therefore, the conventional air-fuel ratio control systems have been required to be improved in precision of control.

SUMMARY OF THE INVENTION

An air-fuel ratio control system of the present invention is arranged to control the air-fuel ratio of air-fuel mixture to be inducted into an engine in order to accomplish feedback control of the air-fuel ratio into a stoichiometric value or feedforward control of the air-fuel ratio into a lean value leaner than the stoichiometric value. The air-fuel ratio control system is comprised of means for detecting the air-fuel ratio of the air-fuel mixture, and a unit for detecting operating condition of the engine. A control means is provided to calculate an air-fuel ratio correction coefficient. The control unit is adapted to form a plurality of learning areas defined respectively by engine operating conditions. Learning can be made in each learning area. At least a part of each learning area is under the feedback control. The control unit is further adapted to calculate a learning coefficient for the learning area corresponding to the detected engine operating condition, in accordance with the air-fuel ratio correction coefficient under the feedback control. The learning coefficient is memorized in the above-mentioned at least a part of each learning area. The feedforward control of the air-fuel ratio is accomplished in accordance with the learning coefficient.

Accordingly, a learning value is memorized in each of the learning areas which are defined by the engine operating conditions. At least a part under the feedback control into the stoichiometric value is formed each learning area, so that feedback control is carried out in a lean region in which the engine is operated at the lean air-fuel ratio. Consequently, the learning value in high precision obtained under the feedback control in the corresponding learning area is used in the feedforward control of the air-fuel ratio into the lean value, thereby effectively improving precision of air-fuel ratio control. This largely improves exhaust emission control and driveability of the engine.

DETAILED DESCRIPTION OF THE INVENTION

Figure 1:
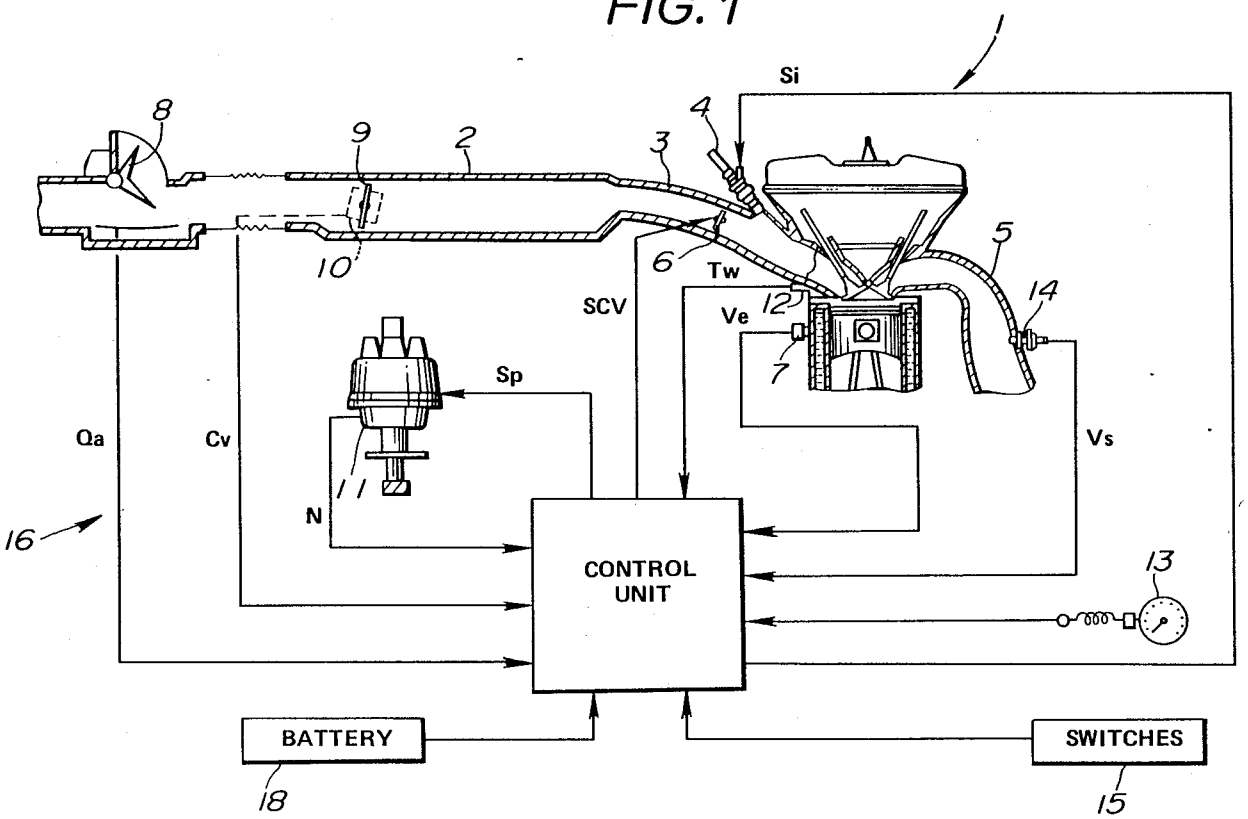
FIG. 1 is a schematic illustration of an air-fuel ratio control system in accordance with the present invention, incorporated with an internal combustion engine.
Figure 2:
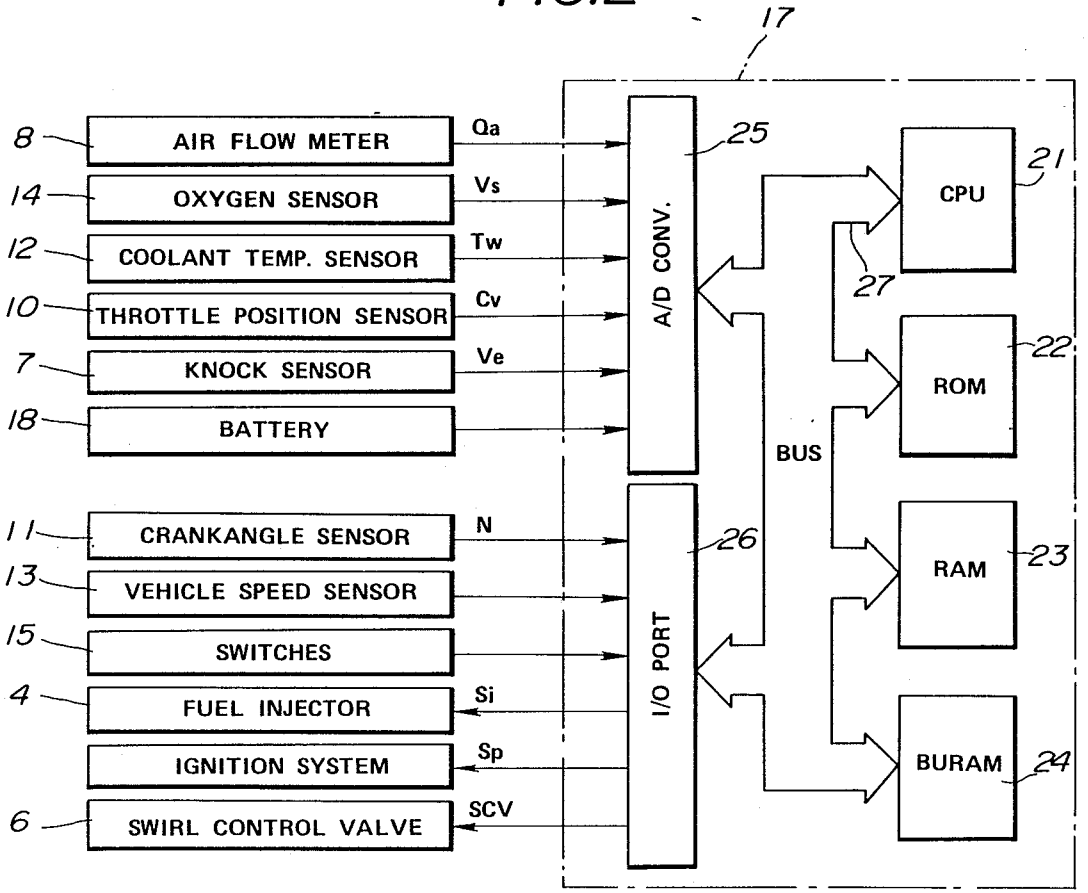
FIG. 2 is a circuit diagram of a control unit used in the air-fuel ratio control system of FIG. 1.

Referring now to FIGS. 1 and 2, there is shown a first embodiment of an air-fuel ratio control system in accordance with the present invention. The air-fuel ratio control system in this embodiment is used in combination with an internal combustion engine 1 of an automotive vehicle (not shown). As shown in FIG. 1, the engine 1 has a plurality of engine cylinders (no numerals) and provided with an intake manifold 3 connected with an intake pipe 2, so that intake air is supplied to each engine cylinder through the intake pipe 2 and the intake manifold 3. A fuel injector 4 is disposed to inject fuel to the upstream side of each engine cylinder in accordance with an injection signal representative of fuel injection amount Si, so that the fuel is fed together with the intake air into each engine cylinder. The engine 1 is provided with an exhaust pipe 5 through which exhaust gas generated in each engine cylinder is introduced through the exhaust pipe 5 into a catalytic converter (not shown) in, which harmful components in the exhaust gas are converted into harmless ones. The thus purified exhaust gas is discharged from the catalytic converter into atmospheric air. A swirl control valve 6 is disposed near the intake port of each engine cylinder and arranged to be regulated in its opening degree or position by a servo-diaphragm, solenoid valve or the like though not shown. Additionally, an engine knock sensor 7 is provided to detect vibration Ve of the engine 1.

An air flow meter 8 is provided to the intake pipe 2 in order to detect the flow amount Qa of the intake air flowing through the intake pipe 2. The intake air flow amount Qa is controlled by a throttle valve 9 rotatably disposed inside of the intake pipe 2. The opening degree or position of the throttle valve 9 is detected by a throttle valve opening degree or position sensor 10. The engine speed N of the engine 1 is detected by a crank angle sensor 11. The coolant temperature Tw of engine coolant flowing through a water jacket (no numeral) of the engine 1 is detected by a temperature sensor 12. The vehicle speed of the vehicle on which the engine 1 is mounted is detected by a vehicle speed sensor 13. The oxygen concentration Vs in the exhaust gas from the engine cylinders is detected by an oxygen sensor 14 attached to the exhaust pipe 5. Additionally, a variety of signals are output from various switches 15 such as a key switch.

An operating condition detecting means 16 is constituted by the above-mentioned air-flow meter 8, the throttle valve position sensor 10 and the crankangle sensor 11. The output from the operating condition detecting means 16, the knock sensor 7, the coolant temperature sensor 12, the vehicle speed sensor 13, the oxygen sensor 14 and the various switches 15 are input to a control unit 17 which is supplied with electric power from a battery 18. The control unit 17 is constituted by a CPU 21, a ROM 22, a RAM 23, a BURAM 24, an analog-to-digital (A/D) converter 25 having a multiplexer, and an input/output (I/O) port 26 having a buffer memory. These elements constituting the control unit 17 are electrically connected with each other through a common bus 27. The A/D converter 25 is adapted to convert the signals representative of Qa, Ve, Cv, Tw, Vs (input as analog signals) into digital signals and output them to the CPU 21, the RAM 23 or the BURAM 24 at predetermined timings in accordance with the commands from the CPU 21.

The CPU 21 is adapted to take in necessary outside data in accordance with a program written in the ROM 22, and to conduct transfer of data between he RAM 23 and the BURAM 24, thereby calculating necessary processing data and outputting processed data to the I/O port 26 when necessary. The crankangle signal representative of engine speed N is input from the crankangle sensor 11 to the I/O port 26 which, in turn, outputs the injection signal representative of Si, an ignition signal representative of spark timing Sp, a swirl control signal SCV representative of opening degree of the valve 6, and the like. The injection signal representative of Si is output to the fuel injector 4 to command fuel injection from the fuel injector 4. The ignition signal representative of Sp is output to an ignition system to command ignition of a spark plug (not shown) disposed in each engine cylinder. The swirl control signal representative of SCV is output to control the swirl control valve 6. The ROM 22 stores an operating program for the CPU 21. The RAM 23 memorizes data, as the form of map, to be used for operation of the CPU 21. Although the memorized content of the RAM 23 disappears after stopping of the engine, the memorized content (learning value and the like) of the BURUM 24 is maintained even after the engine stopping because the BURAM 24 is constituted, for example, by a non-volatile memory.

The manner of operation of the air-fuel ratio control system according to the present invention will be discussed hereinafter.

First the fundamental principle of the system will be explained. With a so-called ECCS (Electronic Concentrated engine Control System) corresponding to the system according to the present invention, the air-fuel ratio of air-fuel mixture supplied to the engine 1 is determined by detecting the oxygen concentration of exhaust gas by the oxygen sensor 14. In accordance with the thus determined air-fuel ratio, the amount of fuel injected from the fuel injector 4 is regulated thereby to accomplish feedback control of the air-fuel ratio toward a stoichiometric target value. In other words, the pulse width Ti of injection pulse signal (representative of the final injection amount) corresponding to the injection signal (Si) is calculated in accordance with the various detected values such as the air-fuel ratio, the intake air flow amount, the engine speed and coolant temperature and is given by the following equation (1):

$$Ti = Tp \times COEF \times FBYA \times LAMBDA \times KBLRC \times Ts \quad \text{Eq. (1)}$$

where Tp is the standard pulse width, COEF is the various correction coefficient, FBYA is the fuel-air ratio correction coefficient, LAMBDA is the air-fuel ratio (feedback) correction coefficient, KBLRC is the (air-fuel ratio) learning (correction) coefficient, and Ts is the voltage correction amount or value. The above-mentioned standard pulse width Tp is calculated, for example, in accordance with the air flow amount Qa and the engine speed N.

The calculation of the equation (1) gives usual injection amount of fuel which is injected at a predetermined crankangle per each engine revolution. Now, usual air-fuel ratio control includes a so-called stoichiometric control in which the standard pulse width Tp is multiplied by the air-fuel ratio correction coefficient LAMBDA which is calculated in accordance with the output signal from the oxygen sensor thereby to accomplish the feedback control toward the stoichiometric air-fuel ratio ($\lambda=1$) from the view point of exhaust gas emission control, and a so-called lean control in which the standard pulse width Tp is multiplied by the fuel-air ratio coefficient FBYA not higher than 1 thereby to accomplish feedforward control toward a high or lean air-fuel ratio (learner than the stoichiometric value) from the view point of saving fuel. These control modes are changed in accordance with the engine operating conditions at that time. In other words, in the stoichiometric control, a learning control is carried out to accomplish the feedback control in such a manner as to make the error of the system zero upon multiplying the standard pulse width Tp by the learning coefficient KBLRC which is calculated in accordance with the air-fuel ratio correction coefficient LAMBDA in one of a plurality of learning areas corresponding to the operating condition, each learning area being defined by engine load and engine speed. In the lean control, the feedforward control is carried out in such a manner as to make the error of the system zero upon multiplying the standard pulse width Tp by the learning coefficient KBLRC which is calculated under the stoichiometric control in the learning area corresponding to the operating condition. Accordingly, in the learning area within an operating region (referred to as "lean region") under an operating condition in which the lean air-fuel ratio is selected, none of the air-fuel ratio control and the learning control is carried out and therefore high control accuracy cannot be secured.

In view of the above, to improve the feedforward control in the lean region, it has been found that the respective learning areas defined by engine load and engine speed are divided in such a manner that engine operation cannot be carried out only under the lean control in each learning area, so that the chance of engine operation under the stoichiometric control is given to each learning area thereby to employ, in the lean control, the learning coefficient KBLRC obtained during the learning control under the stoichiometric control, thus securing the accurateness of control of the system. This can effectively raise the accuracy in air-fuel ratio control, thereby improving exhaust emission control and driveability of the engine.

Figure 3:
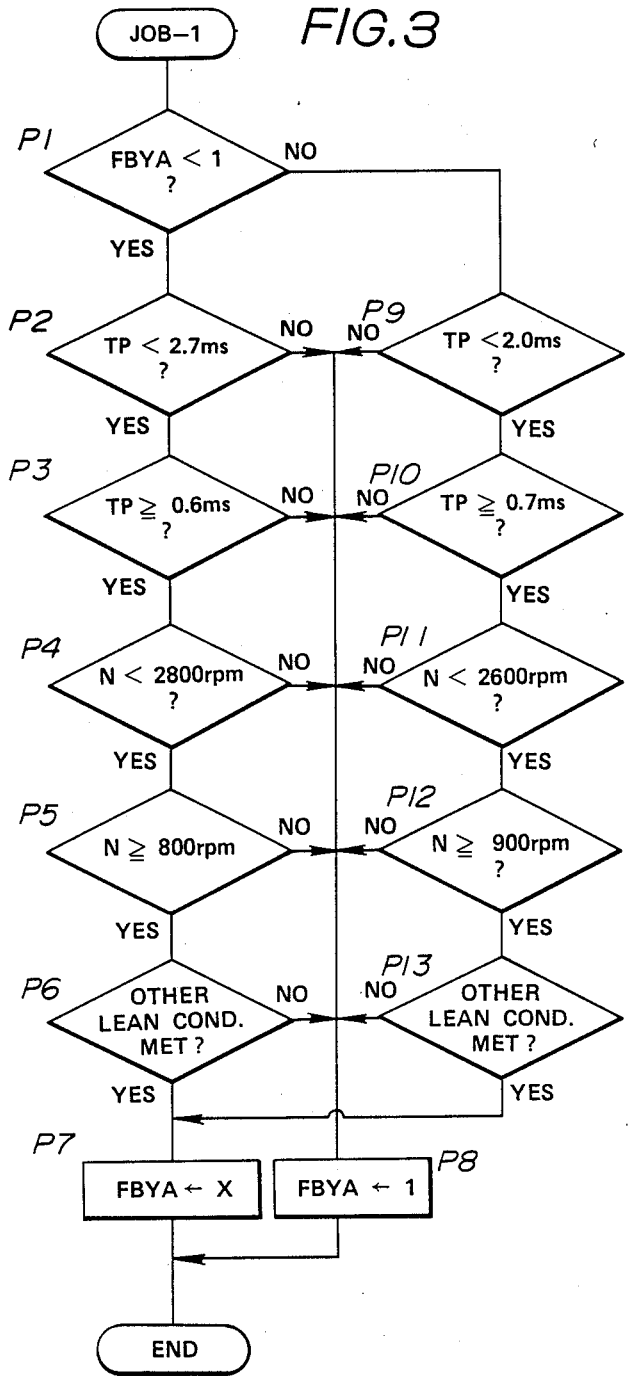
FIG. 3 is a flowchart showing a program for calculating a fuel-air ratio coefficient, executed in the control unit of FIG. 2.
Figure 4:
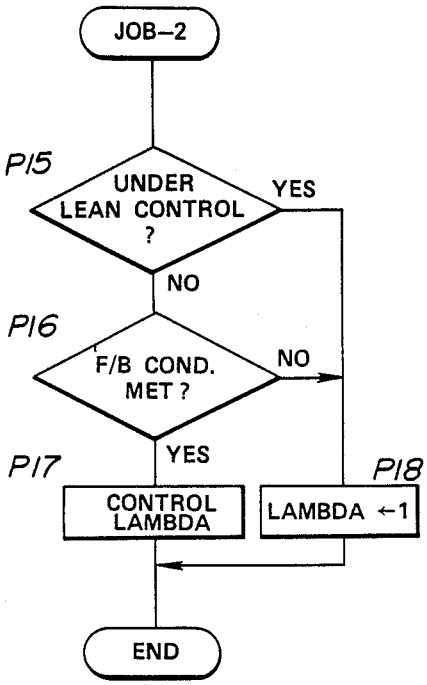
FIG. 4 is a flowchart showing a program for calculating an air-fuel ratio correction coefficient, executed in the control unit of FIG. 2.
Figure 5:
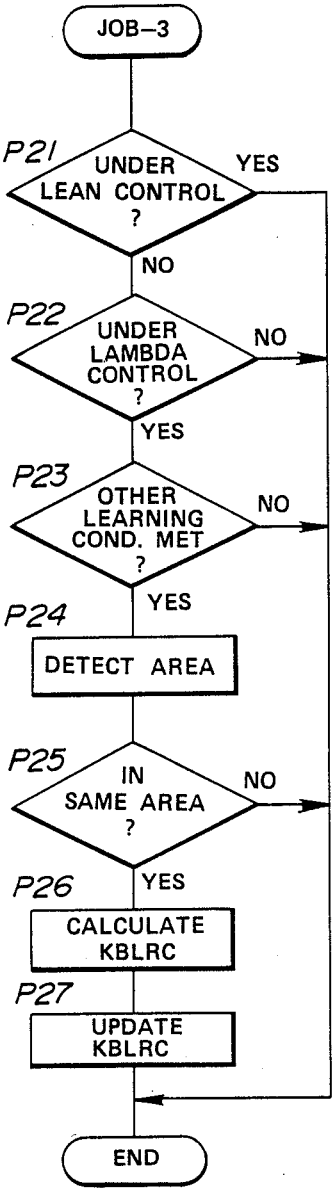
FIG. 5 is a flowchart showing a program for calculating a learning coefficient, executed in the control unit of FIG. 2.

The above-discussed fundamental principle of the air-fuel ratio control is carried out, for example, according to the programs JOB-1 to JOB-3 of the flowcharts in FIGS. 3 to 5.

FIG. 3 shows a routine of the program JOB-1 for calculating the fuel-air ratio coefficient FBYA, the routine being carried out at intervals of a predetermined time. First, discrimination is made as to whether the fuel-air ratio coefficient FBYA at the prior time is smaller than 1 ($FBYA<1$) or not at a step P1. When $FBMA<1$, the decision of lean air-fuel ratio at the prior time is made and therefore the program goes to a step P2. At the step P2, when $FBYA\geqq 1$, the program goes to a step P9. Hereinafter, at the steps P2 to P6 and P9 to P13, discrimination is being made as to whether or not the present operating condition resides in the region (i.e., the lean region) in which the lean air-fuel ratio can be selected. More specifically, at the step P2, discrimination is made as to whether the standard pulse width Tp is smaller than 2.7 ms ($Tp<2.7$) or not. When $Tp<2.7$, discrimination is made as to whether Tp is not smaller than 0.6 ms ($Tp\geqq 0.6$) or not at the step P3. When $Tp\geqq 0.6$, discrimination is made as to whether N is not lower than 800 rpm ($N\geqq 800$) or not at the step P5. Subsequently, when $N\geqq 800$, discrimination is made as to whether other conditions (lean conditions) necessary for carrying out so-called cruising lean control at the step P6. The conditions in this step correspond to, for example, engine coolant temperature, vehicle speed and the like. When the lean conditions are met, a predetermined value X ($X<1$) is selected for the fuel-air ratio coefficient FBYA at the present time at step P7, thereby completing the present time operation. Otherwise, when the predetermined condition is not met in each step (P2 to P6), decision that all the conditions are not suitable for the cruising lean control is made, so that the fuel-air ratio coefficient is substituted by "1" ($FBYA=1$) at the step P8 thereby completing the present time operation.

When $FBYA\leqq 1$ at the step P1, discrimination is made as to whether the standard pulse width Tp is smaller than 2.0 ms ($Tp<2.0$) or not at the step P9.

Figure 6:
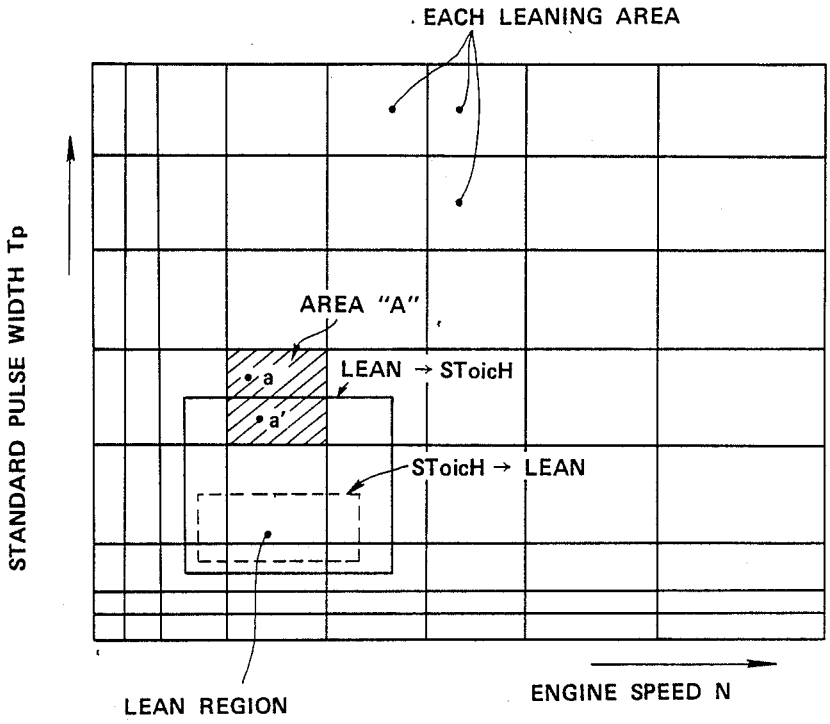
FIG. 6 is a graph for illustrating the operation and function of the air-fuel ratio control system of FIG. 1.

When $Tp<2.0$, discrimination is made as to whether Tp is not smaller than 0.7 ms ($Tp\geqq 0.7$) or not at the step P10. When $Tp\geqq 0.7$, discrimination is made as to whether the engine speed N is lower than 2600 rpm ($N<2600$) or not at the step P11. When $N<2600$, discrimination is made as to whether N is not lower than 900 rpm ($N\geqq 900$) or not at the step P12 Subsequently, when $N\geqq 900$, discrimination is made as to whether the above-mentioned other lean condition is met or not at the step P13. When the lean condition is met, the predetermined value X ($x<1$) is selected for the fuel-air ratio coefficient at the present time n the step P7 thus completing the present time operation. Otherwise, when the predetermined condition is not met in each step (P9 to P13), a decision that all the conditions are not suitable for the cruising lean control is made, so that the fuel-air ratio coefficient is substituted by "1" ($FBYA=1$) at the step P8 thus completing the present time operation. By carrying out the above routine, discrimination is made as to whether the operating condition of the engine comes into the lean region from the stoichiometric region (the engine is operated at a stoichiometric air-fuel ratio) as indicated by a broken-line rectangular, or comes into the stoichiometic region from the lean region as indicated by a solid-line rectangle in FIG. 6, thereby determining the suitable fuel-air ratio coefficient FBYA. As shown in FIG. 6, a difference in region is made between the case in which engine operation shifts from the stoichiometric region to the lean region and the case in which engine operation shifts from the lean region to the stoichiometric region. In other words, so-called hysteresis is formed between the above-mentioned two cases, thereby suppressing shock and NOx emission during the change of engine operation between the stoichiometric and lean regions while maintaining the wider lean region.

FIG. 4 shows a routine of the program JOB-2 for calculating the air-fuel ratio correction coefficient LAMBDA, the routine being carried out at intervals of a predetermined time. First, discrimination is made as to whether feedback condition (in which feedback control is carried out) is met or not at a step P16. When the feedback condition is met, the air-fuel ratio correction coefficient is increased or decreased in accordance with the output signal from the oxygen sensor 14 at a step P17 thereby to accomplish so-called lambda control in which the fuel injection amount of the fuel injector 4 is controlled in such a manner as to regulate the air-fuel ratio to the stoichiometric value ($\lambda=1$), thus completing the present time operation. Otherwise, when the engine operation is in the lean region, i.e., the feedback condition is not met, "1" is selected for the air-fuel ration correction coefficient LAMBDA, thus completing the present time operation.

FIG. 5 shows a routine of the program JOB-3 for calculating the learning coefficient KBLRC, the routine being carried out at intervals of a predetermined time. First, discrimination is made as to whether the engine operation is within the lean region or not at a step P21. When not within the lean region, discrimination is made as to whether the lambda control (air-fuel ratio feedback control) is being carried out or not at a step P22. When under the lambda control, discrimination is made as to whether "other learning conditions" are met or not at a step 23. When the other learning conditions are met, the learning area corresponding to the operating condition at that time is detected at a step P24. Here, the "other learning conditions" include, for example, the following conditions:

(1) The difference between the maximum and minimum outputs of the oxygen sensor is above a predetermined value;

(2) Several samplings of the output of the oxygen sensor has been made upon the engine speed N and the standard injection amount Tp fall within a range of the learning control; and (3) The control cycle of the oxygen sensor is less than a standard value.

At a step P25, discrimination is made as to whether the learning area detected at the step 24 is within the same area or not. When in the same area, the learning coefficient KBLRC is calculated at a step P26. Subsequently, the learning coefficient KBLRC is updated in accordance with the average value of the air-fuel ratio correction coefficient LAMBDA at a step P27, thus completing the present time operation. Otherwise, when the predetermined condition is not met in each step (P21, P22, P23, P25), no calculation of the learning coefficient KBLRC is carried out, thereby completing the present time operation.

Figure 7:
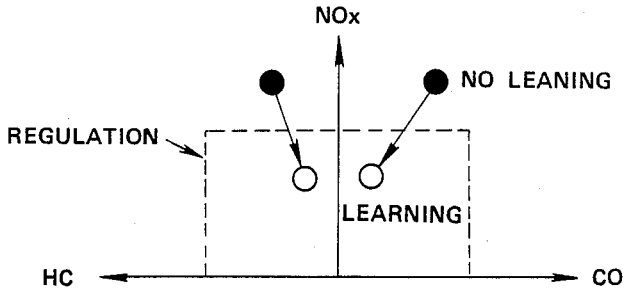
FIG. 7 is a graph for showing the effect of the air-fuel ratio of FIG. 1.

Thus, in this embodiment illustrated in FIGS. 3 to 6, the learning area in which the air-fuel ratio is feedback-controlled to the stoichiometric value is formed at least a part of each learning area (or operating region), so that the cruising lean control (within the lean region) is carried out by using a high precision learning value in the stoichiometric control. For example, as shown in FIG. 6, in a hatched learning area A, learning has been already made in an operating condition a in which the engine is operated under the stoichiometric control, so that the learning value obtained in such learning is also used in another operating condition a' in which the engine is operated under the lean control, thereby improving precision of air-fuel ratio control. Accordingly, under such a learning control, harmful components such as HC (hydrocarbons), NOx (nitrogen oxides) and CO (carbon monoxide) in exhaust gas can be decreased to fall within the region of a regulation of exhaust gas emission control as shown in FIG. 7 in which each dard circle indicates a value under no learning control while each light circle indicates a value under the learning control.

Furthermore, with this embodiment, since no additional special sensors and parts are necessary, conventional parts for an air-fuel ratio control system can be used without modification in the side of a hardware. In other words, the system of this embodiment can be provided by modification of only the side of a software, thereby avoiding complication and production cost increase of the air-fuel ratio control system.

FIGS. 8 to 12 illustrate a control manner of a second embodiment of the air-fuel ratio control system in accordance with the present invention, which is similar to that of the first embodiment system with the exception that calculation of the number of the times of learning is added to each routine programs JOB-1 to JOB-3. For the purpose of simplification of illustration, the same characters as in the first embodiment are assigned to the corresponding steps to omit their explanation, so that explanation will be made only for different steps to which characters encircled by circles are assigned.

Figure 8:
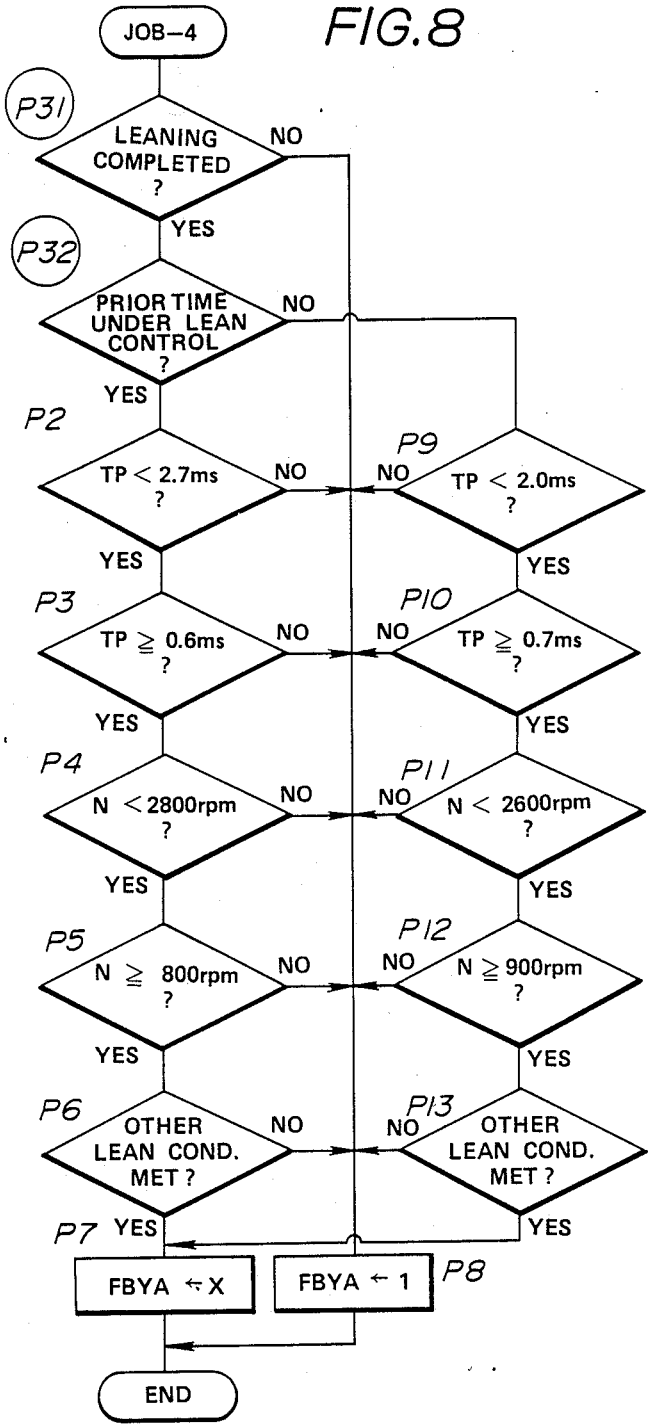
FIG. 8 is a flowchart similar to FIG. 3 but showing the corresponding program of a second embodiment of the air-fuel ratio control system in accordance with the present invention.

FIG. 8 shows a routine of a program JOB-4 for calculating the fuel-air ratio coefficient FBYA which program corresponds to the program JOB-1 in the first embodiment. In this program, discrimination is first made as to whether learning has been already completed or not at a step P31. When completed, discrimination is made as to whether the lean control was carried out or not at the prior time at a step 32. When the lean control was carried out at the prior time, the program goes to the step P2. Otherwise, when the lean control was not carried out at the prior time, the program goes to the step P9.

Figure 9:
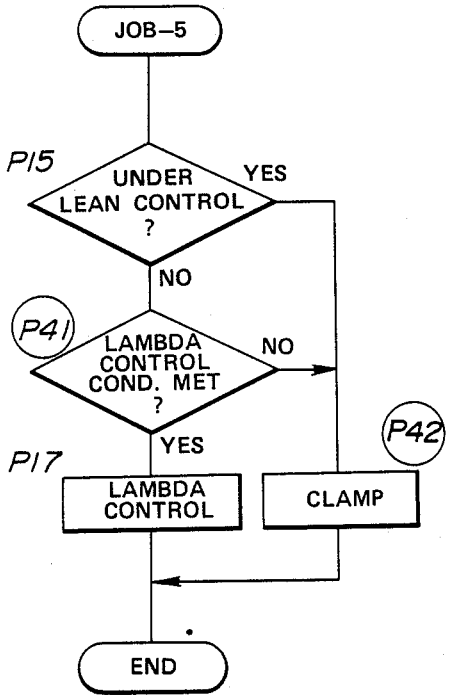
FIG. 9 is a flowchart similar to FIG. 4 but showing the corresponding program of the second embodiment air-fuel ratio control system.

FIG. 9 shows a routine of a program JOB-5 for calculating the fuel-air ratio coefficient FBYA which program corresponds to the program JOB-2 of the first embodiment. In this program, when decision of no lean control is made at the step P15, discrimination is made as to whether conditions for the lambda control are met at a step P41. When the lean control is carried out or the lambda control conditions are not met, clamping is made at a step 42 thereby to complete the present time operation.

Figure 10:
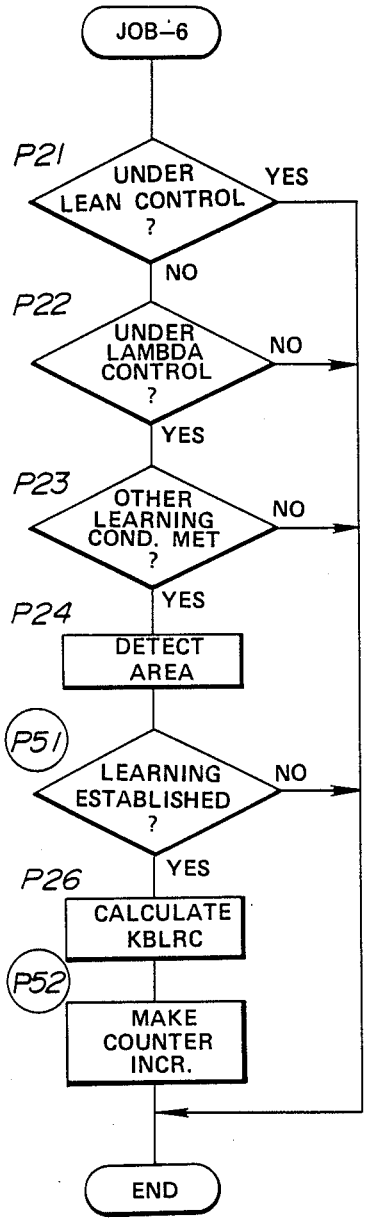
FIG. 10 is a flowchart similar to FIG. 5 but showing the corresponding program of the second embodiment air-fuel ratio control system.
Figure 11:
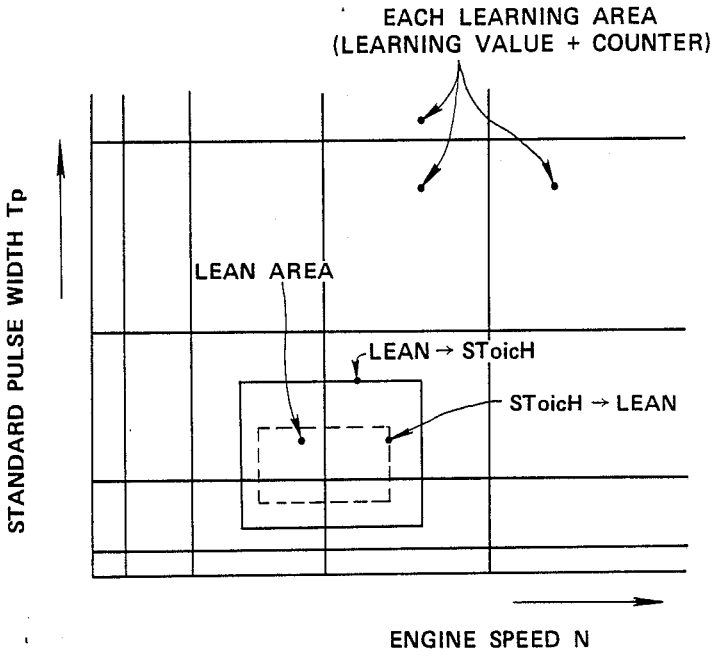
FIG. 11 is a graph similar to FIG. 6 but showing the operation and function of the second embodiment air-fuel ratio control system.

FIG. 10 shows a routine of a program JOB-6 for calculating the learning coefficient KBLRC which program corresponds to the program JOB-3 of the first embodiment. In this program, upon passing through the step P24, discrimination is made as to whether the learning is established or not at a step P51. When established, counter increment is made to increase the number of times of learning recorded in a learning counter at a step P52 upon passing through the step P26.

Figure 12:
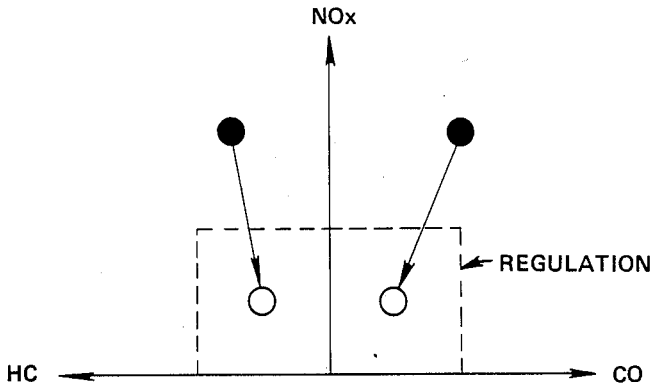
FIG. 12 is a graph similar to FIG. 7 but showing the effect of the second embodiment air-fuel ratio control system.

Thus, in this embodiment, the counter is provided for each learning area to monorize the proceeding of learning, in which lean control is prohibited in case in which the count value of the learning counter for the learning area corresponding to the operating condition for the learn control is smaller than a predetermined level, thus further improving the precision of air-fuel ratio control. Accordingly, exhaust emission control effect of this embodiment is further improved as shown in FIG. 12, over that of the first embodiment as shown in FIG. 7.

What is claimed is:

1. An air-fuel ratio control system for an engine, comprising:

means for detecting air-fuel ratio of air-fuel mixture to be inducted to the engine;

means for detecting operating condition of the engine;

means for calculating an air-fuel ratio correction coefficient in accordance with said detected air-fuel ratio;

means for accomplishing feedback control of the air-fuel ratio into a stoichiometric value in accordance with said air-fuel ratio correction coefficient;

means for forming a plurality of learning areas defined respectively by engine operating conditions, learning being able to be made in each learning area, at least a part of each learning area being under said feedback control and at least one of said learning areas having a part which is never under feedback control;

means for calculating a learning coefficient for said learning area corresponding to said detected engine operating condition, in accordance with said air-fuel ratio correction coefficient under said feedback control, said learning coefficient being memorized in said at least a part of each learning area; and means for accomplishing feedforward control of the air-fuel ratio into a lean value which is leaner than said stoichiometric value, in accordance with said learning coefficient.

2. An air-fuel ratio control system as claimed in claim 1, further comprising means for calculating amount of fuel to be supplied to the engine in said detected engine operating condition, in accordance with at least one of said air-fuel ratio correction coefficient and said learning coefficient.

3. An air-fuel ratio control system as claimed in claim 2, further comprising means for supplying the fuel in said calculated amount, into the engine.

4. An air-fuel ratio control system as claimed in claim 1, wherein at least one of said learning areas includes a first part under said feedback control, and a second part under said feedforward control.

5. An air-fuel ratio control system as claimed in claim 1, wherein each learning area is defined by engine load and engine speed of the engine.

6. An air-fuel ratio control system as claimed in claim 2, further comprising means for outputting a pulse signal corresponding to said calculated fuel amount, said fuel supplying means being arranged to control the fuel to be supplied to the engine in accordance with said pulse signal, said pulse signal having a pulse width which is obtained by modifying a standard pulse width corresponding to said detected engine operating condition in accordance with at least one of said air-fuel ratio correction coefficient and a fuel-air ratio coefficient not larger than 1.

7. An air-fuel ratio control system as claimed in claim 6, wherein said standard pulse width is multiplied by said air-fuel ratio coefficient to obtain said pulse width of said pulse signal in said feedback control, wherein said standard pulse width is multiplied by said fuel-air ratio coefficient to obtain said pulse width of said pulse signal in said feedforward control.

8. An air-fuel ratio control system as claimed in claim 6, wherein aid standard pulse width is multiplied by said learning coefficient to obtain said pulse width of said pulse signal both in said feedback and feedforward controls.

9. An air-fuel ratio control system as claimed in claim 1, wherein said learning coefficient to be used in said feedforward control is calculated for said learning area in which each of said feedback and feedforward control is made.

10. An air-fuel ratio control system as claimed in claim 4, wherein said learning coefficient calculated for said learning area first part is used for feedforward control in said learning area second part.

11. An air-fuel ratio control system as claimed in claim 1, further comprising means for memorizing the number of times of learning in said learning area under said feedback control which learning area corresponds to that under which said feedforward control is made, and means for prohibiting said feedforward control in case the number of times of said learning is smaller than a predetermined level.

* * * * *